US005441420A

United States Patent [19]

Okumura et al.

[11] Patent Number: 5,441,420

[45] Date of Patent: Aug. 15, 1995

[54] LEVER-TYPE CONNECTOR

[75] Inventors: Hitoshi Okumura; Osamu Taniuchi; Hajime Kawase, all of Yokkaichi, Japan

[73] Assignee: Sumitomo Wiring Systems, Ltd., Mie, Japan

[21] Appl. No.: 214,238

[22] Filed: Mar. 17, 1994

[30] Foreign Application Priority Data

Mar. 19, 1993 [JP] Japan ..... 5-018643 U

[51] Int. Cl.[6] ..... H01R 13/62

[52] U.S. Cl. ..... 439/157; 439/592; 439/586

[58] Field of Search ..... 439/152–160, 439/372, 341, 586, 587, 595, 586

[56] References Cited

U.S. PATENT DOCUMENTS 5,230,635 7/1993 Takenouchi et al. ..... 439/153
5,332,330 7/1994 Kaneko ..... 439/357

FOREIGN PATENT DOCUMENTS 4-62772 2/1992 Japan .
2179506 3/1987 United Kingdom .

*Primary Examiner*—David L. Pirlot
*Attorney, Agent, or Firm*—Oliff & Berridge

[57] ABSTRACT

To fit male and female connector housings together without tilting, an inner bottom surface of a hood portion of a male connector housing has step portions formed at the four respective corner portions, and a recessed portion having a lower height than the step portions. The female connector housing can be fully inserted because of a gap provided between a bulged portion of the female connector housing and the recessed portion. The female connector housing, when further inserted, slides at its opposite ends to change its posture so that male and female terminals are completely connected together.

13 Claims, 6 Drawing Sheets

LEVER-TYPE CONNECTOR

BACKGROUND OF THE INVENTION

This invention relates to a connector, and more particularly to a connector of the type having a connection effected using a lever.

Connectors utilizing levers have an advantage in that connection and disconnection can be effected with a small force. This has been applied particularly to multipole connectors. The fundamental construction of such connectors is known and described in Japanese Patent Unexamined Publication No. 4-62772 as follows.

A number of male terminals are provided in a male connector housing serving as a receiving connector housing. A number of female terminals are provided in a female connector housing to be inserted into the male terminals. A lever with cam grooves for effecting leverage is pivotally mounted on the male connector housing, and engagement projections are provided on a central portion of a lower portion of a cover mounted on the female connector housing.

The engagement projections of the cover are respectively engaged in the cam grooves of the lever for connecting the two connector housings together. In this condition, the lever is pivotally movable. As a result, the cover and the female connector housing are inserted into the male connector housing by a cam action of the cam grooves so that the male and female terminals of the two connector housings are connected together against a mechanical insertion resistance, thus completing the connection of the two connector housings.

The group of terminals provided in each connector housing are not always of the same type and are not always arranged and distributed uniformly. For example, a so-called hybrid type is shown in FIG. 7A in which a smaller number of power terminals 1*a* and a larger number of signal terminals 1*b* are provided in a male connector housing In such a type, when a female connector housing 2 is to be inserted into a male connector housing 1, a large unbalance of a mechanical insertion resistance may occur between the right and the left regions of the group of terminals 1*a*, 1*b*.

If such insertion resistance unbalance is encountered, the female connector housing 2 is inserted in a tilted manner, as shown in FIG. 7A, so that the opposite end edges of the female connector housing 2 interfere with an inner surface of the male connector housing 1 at two points, which are designated, respectively, by reference characters X and Y in FIG. 7B.

The female connector housing 2 is generally made of a synthetic resin material. An engagement projection 4 engaged in a cam groove 3*a* of a lever 3 is provided at a central position in the X-Y direction. Therefore, the female connector housing 2 is elastically deformed by a pressing force applied to the engagement projection 4 through leverage of the lever 3 such that the lower surface of the female connector housing 2 bulges between the two points X and Y. This bulged portion abuts against the bottom surface of the male connector housing 1 so that the female connector housing 2 cannot be further inserted. As a result, the female connector housing 2 remains tilted relative to the male connector housing 1. This may cause problems because the connection of the terminals is incomplete, which therefore invites incomplete contact.

In a connector where two connector housings are inserted relative to each other by hand, even if there is an unbalanced distribution of the insertion resistance, such unbalance of the insertion resistance can be readily perceived by the operator, and therefore, it can be corrected relatively easily. However, in the connector type of the above construction, when the female connector housing 2 is pressed down by the connection mechanism utilizing the leverage of the lever 3, faulty insertion cannot be perceived by the operator. Therefore, even if an incomplete connection occurs, the operator assumes that the connection of the connector has been properly made. It is desirable therefore to solve this problem.

SUMMARY OF THE INVENTION

An object of the present invention is to provide a connector where even if there is an unbalance in insertion resistance, the two connector housings are prevented from being inserted in a tilted manner relative to each other, thereby preventing incomplete contact of terminals.

The present invention provides a lever-type connector having a lever that is pivotally mounted on one of two connector housings of the connector. The connection and disconnection of the connector are effected by the lever. A recessed portion is formed in at least one of opposed surfaces of the two connector housings except for marginal portions such that the opposed surfaces contact each other when the connector is fully connected.

In the connector of the present invention, when a first connector housing is inserted into the second connector housing in a tilted posture, the opposed surface of the first connector housing interferes at its opposite end edges with improper portions of the second connector housing so that the first connector housing is elastically deformed and bulged at a central portion of the opposed surface. Even at this time, a gap due to the recessed portion is secured between the bulged opposed surface and the opposed surface of the second connector housing.

Therefore, the first connector housing is further inserted in an elastically deformed condition. At this time, the first connector housing slides at the opposite end edges of the opposed surface to change its posture. As a result, the two connector housings are connected together in a proper posture without tilting such that the opposite end edges of the opposed surfaces of the two connector housings are in contact with each other.

Thus, in the connector of the present invention, the two connector housings are connected together in the proper posture without tilting, and therefore, an advantage is achieved such that incomplete contact of the terminals is prevented.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

A first preferred embodiment will now be described with reference to FIGS. 1 to 4. The lever-type connector of the present invention comprises a male connector housing 10, a female connector housing 20, and a lever 30.

Figure 1A:
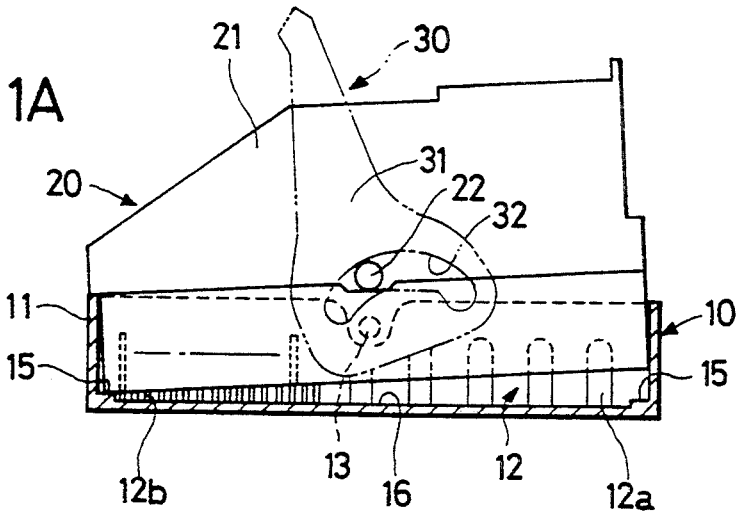
FIGS. 1A–1C are schematic side-elevational views of a first preferred embodiment of a lever-type connector of the present invention showing the process of connection.

The male connector housing 10 is made of a synthetic resin material and has a hood portion 11 into which the female connector housing 20 is tightly fitted. The hood portion 11 has a uniform rectangular horizontal cross-section from its opening to its inner bottom surface. As shown in FIG. 1A, on the inner bottom surface of the hood portion 11 a plurality of male terminals 12 are provided, including power terminals **12*a* of a relatively large size and signal terminals 12*b* of a relatively small size. The power terminals 12*a* are provided at a right region of the inner bottom surface of the hood portion 11 in the direction of the long side of the inner bottom surface, and the signal terminals 12*b*** are provided at the left region of the inner bottom surface.

Lever support shafts 13 are respectively formed on central portions of the opposite side surfaces of the hood portion 11. A lever 30, of a synthetic resin and having two legs 31, is pivotally mounted on the lever support shafts 13 at two legs 31. Each leg 31 has an arcuate cam groove 32. The lever support shafts 13 are inwardly disposed of the arc of the cam groove 32.

The female connector housing 20 is made of a synthetic resin material and has a size and shape that can be tightly fitted in the hood portion 11 of the male connector housing 10. Female terminals (not shown), to be respectively connected to the male terminals 12, are provided in the portion of the female connector housing to be fitted in the hood portion 11.

The female connector housing 20 has a cover 21 that is exposed to the exterior of the hood portion 11 when the female connector housing 20 is fitted in the male connector housing 10. Cam reception projections 22 are respectively formed on opposite side surfaces of the cover 21 to be respectively received in the cam grooves 32 of the legs 31. The cam reception projections 22 cooperate with the lever 30 to connect the male and female connector housings 10 and 20 together.

Figure 1B:
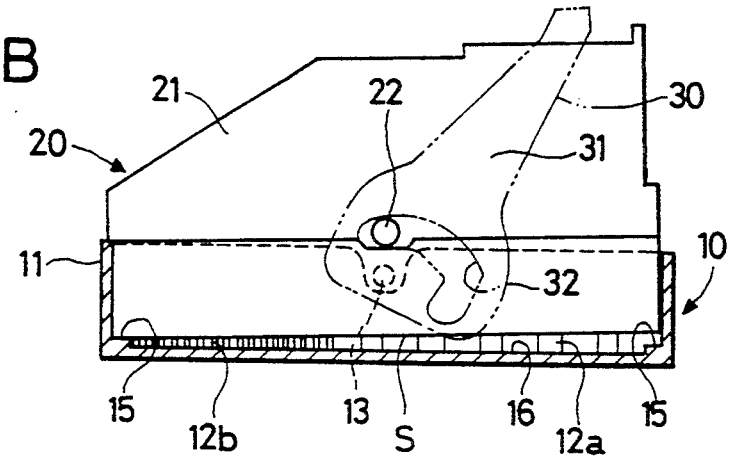
Figure 1C:
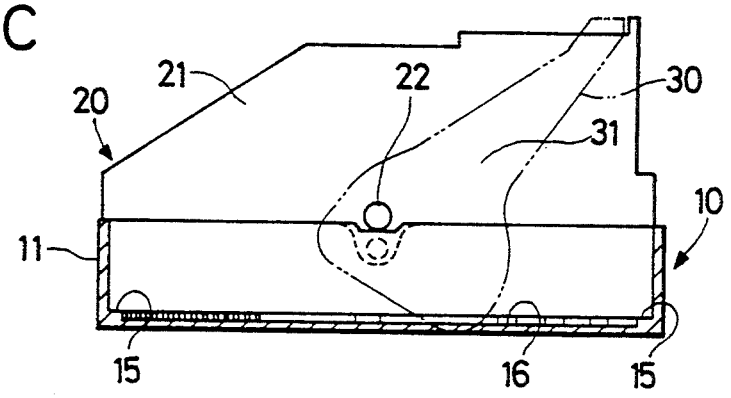

By fitting the female connector housing 20 into the male connector housing 10, the cam reception projections 22 elastically deform the two legs 31 of the lever 30 to urge the two legs 31 away from each other. The cam reception projections 22 are respectively received in the cam grooves 32, thus providing a connection condition. Thereafter, when the lever 30 is pivotally moved, the engagement position between the cam reception projection 22 and the cam groove 32 in the direction of the length of the cam groove 32 is moved relative to the lever support shaft 13 in a direction to reduce the distance between this engagement position and the lever support shaft 13. In accordance with this movement, the female connector housing 20 is inserted deep into the hood portion 11 against the sliding resistance between the male and female connector housings 10 and 20 and the fitting resistances between the male and female terminals. Finally, the female connector housing 20 is abutted against the inner bottom surface of the hood portion 11 so that the terminals are completely coupled and connected together. FIG. 1B shows a partial state of connection between the male connector housing 10 and the female connector housing 20. FIG. 1C shows a fully connected state when the lever 30 is fully rotated.

The male connector housing 10 is provided with means for ensuring a positive connection between the male and female connector housings 10 and 20 as will now be described. Slightly-raised step portions 15 are respectively formed on the four corner portions of the inner bottom surface of the hood portion 11. The other portion of the inner bottom surface of the hood portion 11 provides a recessed portion 16 having a wider area and smaller height than the step portions 15. For example, when the dimension of the long side of the inner bottom surface of the hood portion 11 is approximately 10 cm, the difference in height between the step portion 15 and the recessed portion 16 is approximately 0.5~0.7 mm.

The operation of the first preferred embodiment will now be described. When the female connector housing 20 is fitted into the hood portion 11 by pivotally moving the lever 30, the female connector housing 20 is brought into a tilted posture relative to the male connector housing 10. This is because the fitting resistances of the male power terminals **12*a* and the male signal terminals 12*b* relative to the female terminals are different from each other because of the difference in distribution densities between the power terminals 12*a* and the signal terminals 12*b*. As a result, one of the opposite ends (the left end in FIG. 1B) of the female connector housing 20 is abutted against the upper surfaces of the step portions 15. The other end (the right end in FIG. 1B) interferes with a portion of the inner wall surface of the hood portion 11 slightly above the step portions 15. The insertion of the female connector housing 20** is then in a condition as shown in FIG. 1B.

When the insertion force is further applied from the lever 30 to the female connector housing 20, the central portion of the female connector housing 20 is elastically deformed to bulge downwardly by a pressing force applied through the engagement between the cam grooves 32 of the lever 30 and the cam reception projections 22. The force obtained by combining a resiliently-restoring force (increasing with the increase flexing of the female connector housing 20) with the insertion force of the lever 30 becomes generally equal to the insertion resistance obtained by combining the fitting resistances between the male and female terminals with the frictional resistance at the area of contact between the male and female connector housings 10 and 20. At this time, because of step portions 15 as shown in FIG. 1B, a slight gap S is provided for allowing a further elastic deformation or further insertion of the female connector housing 20 between the bulged portion of the female connector housing 20 and the recessed portion 16 of the hood portion 11.

When the lever 30 is further pivotally moved to apply a pressing force to the cam reception projections 22 in the inserting direction, the female connector housing 20 is further elastically deformed to narrow the gap S between the bulged portion and the recessed portion 16 of the hood portion 11. At the same time, the combined force of the increased resiliently-restoring force of the female connector housing 20 and the insertion force of the lever 30 overcomes the above insertion resistance so that the female connector housing 20 slides on the contact areas (i.e., on the step portions 15 and on the inner wall surface), thereby connecting the female connector housing 20 into a proper posture.

As a result, as shown in FIG. 1C, the female connector housing 20 is inserted to such an extent that the opposite ends of the female connector housing 20, in the direction of the length of the female connector housing 20, are abutted against the step portions 15. The male terminals 12 and the female terminals are therefore completely connected together to thereby prevent imperfect contact of the terminals caused by the tilted fitting of the male and female connector housings 10 and 20 relative to each other.

Figure 2A:
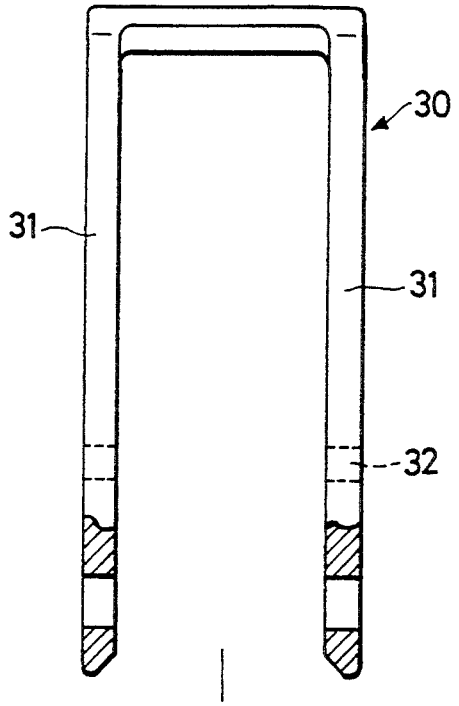
FIGS. 2A–2B are a cross-sectional view of a lever in a disassembled condition.
Figure 2B:
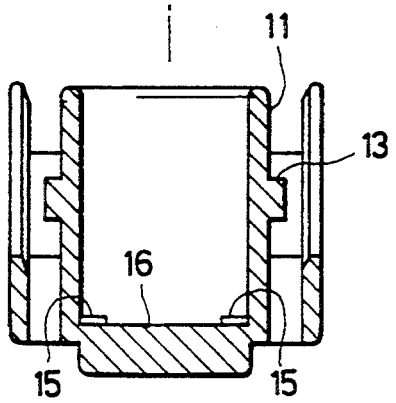
Figure 3:
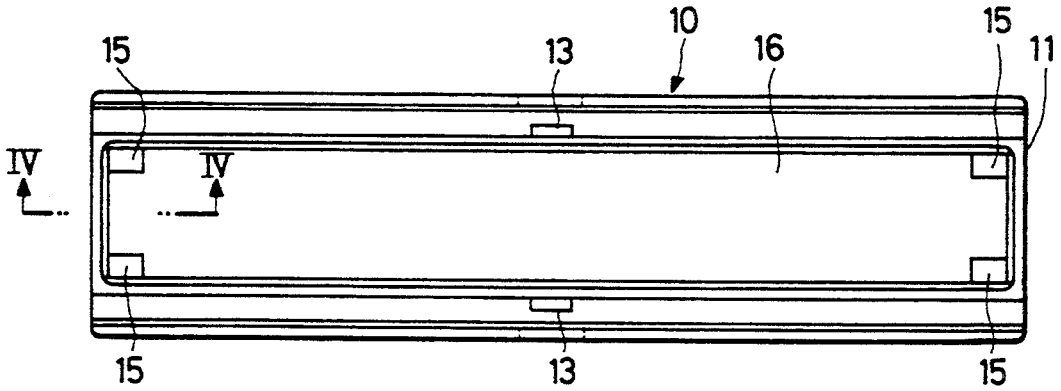
FIG. 3 is a top view of a male connector housing with the terminals omitted.
Figure 4:
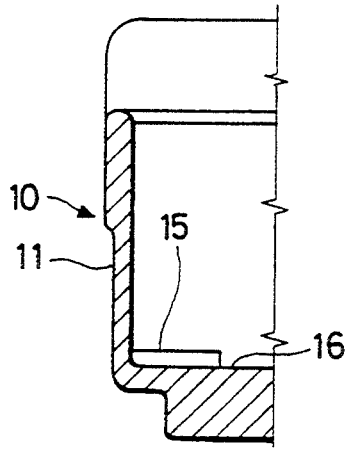
FIG. 4 is a cross-sectional view taken along the line IV—IV of FIG. 3.

FIGS. 2A–2B show the lever 30 in a disassembled condition with respect to the hood portion 11. FIGS. 3 and 4 show different views of the male connector housing with the terminals omitted.

Figure 5:
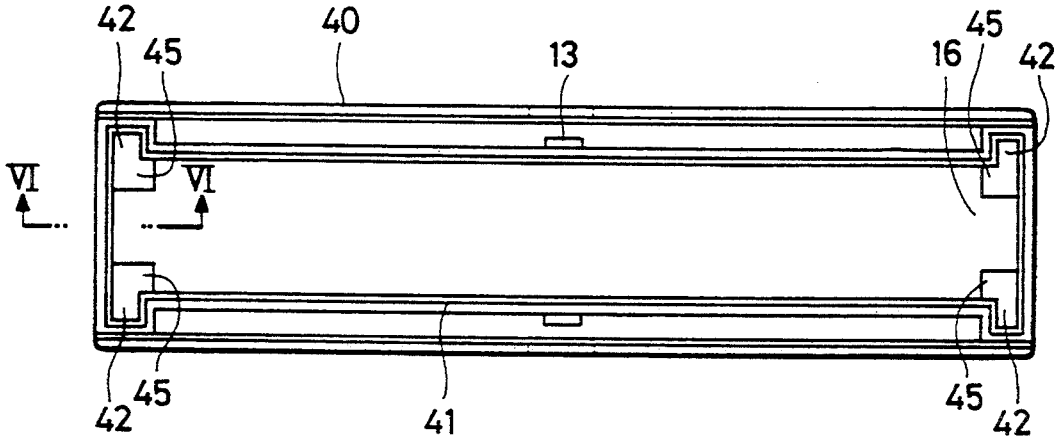
FIG. 5 is a top view of a male connector housing of a second preferred embodiment with the terminals omitted.
Figure 6:
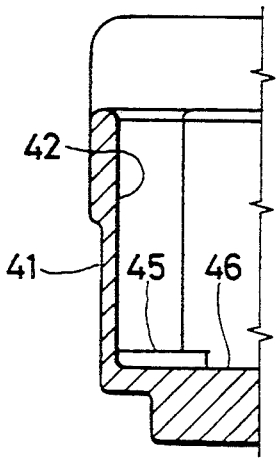
FIG. 6 is a cross-sectional view taken along the line VI—VI of FIG. 5.
Figure 7A:
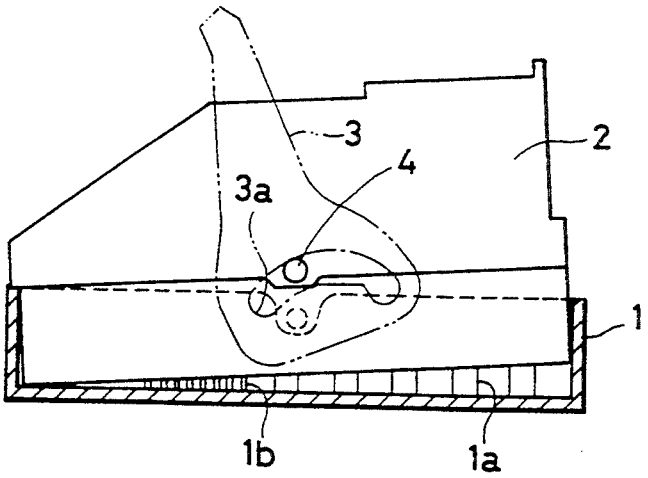
FIGS. 7A–7B are schematic side-elevational views of a conventional lever-type connector showing the problems of such a connector.
Figure 7B:
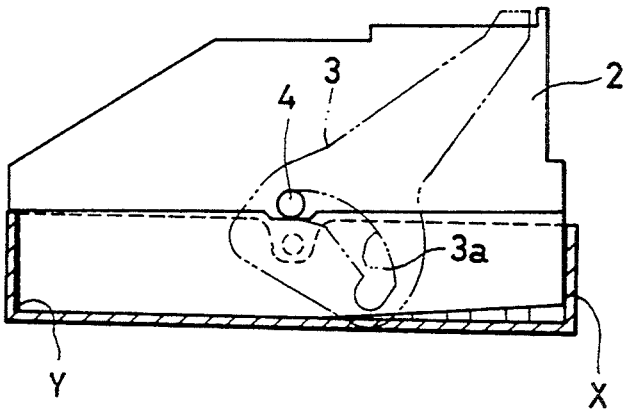

A second preferred embodiment of the present invention will now be described with reference to FIGS. 5 and 6.

In this embodiment, the opposite inner side wall surfaces of a hood portion 41 of a male connector housing 40 provide guide grooves 42 at opposite ends of the hood portion 41. When a female connector housing (not shown in FIGS. 5 and 6) is inserted into the hood portion 41, guide ribs formed on the female connector housing are fitted in the guide grooves 42, respectively, so that the female connector housing is guided to keep a proper posture without being tilted relative to the hood portion 41.

Bottom surfaces of the guide grooves formed in the hood portion 41 are constituted by raised step portions 45 slightly higher than an inner bottom surface of the hood portion 41. Therefore, the inner bottom surface of the hood portion 41 provides a recessed portion 46 lower than the step portions 45.

In this embodiment, the guide ribs are fitted in the guide grooves, and by doing so, the female connector housing can be inserted into the hood portion 41 without being tilted relative to the male connector housing 40. However, even with such a guiding operation, if there is a large difference in insertion resistances of the male and female terminals (not shown), the female connector housing interferes with an inner wall surface of the hood portion 41 with one end abutted against the step portions 45 so that the female connector housing has a tilted posture.

However, the inner bottom surface of the hood portion 41 is formed by the recessed portion 46 lower than the step portions 45, and therefore, even when the female connector housing is elastically deformed to be bulged at its lower surface, a gap for allowing a further elastic deformation and a further insertion of the female connector housing is provided between this bulged portion and the recessed portion 46.

Therefore, in similar operation to that of the first preferred embodiment, the female connector housing is finally fitted in the male connector housing in the proper posture so that the complete connection between the male and female terminals is achieved.

The present invention is not restricted to the above-described embodiments. For example, the following modifications can be made.

Figure 8:
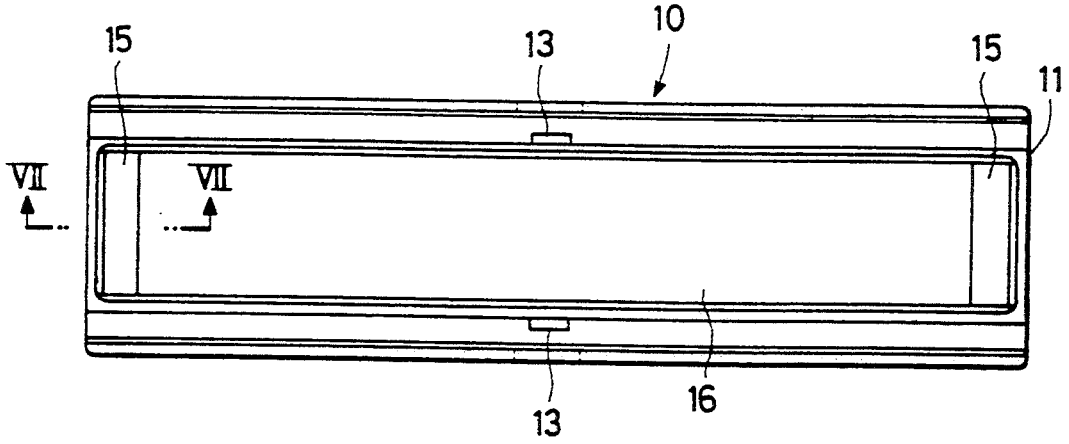
FIG. 8 is a top view of a male connector housing of an alternative embodiment with the terminals omitted.
Figure 9:
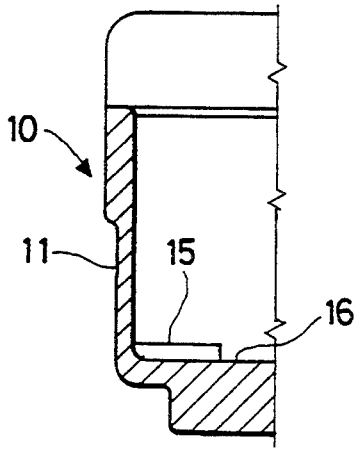
FIG. 9 is a cross-sectional view taken along the line VII—VII of FIG. 8.

(a) In the above embodiments, the step portions are respectively formed at the four corner portions of the inner bottom surface of the hood portion of the male connector housing so as to correct the oblique fitting of the male and female connector housings not only with respect to the tilting in the direction of the long side of the inner bottom surface but also to the tiling in the direction of the short side. Additionally, as shown in FIGS. 8 and 9, two elongate step portions may be respectively formed at the opposite ends of the inner bottom surface of the hood portion 11 and extend respectively along the short sides to correct the oblique fitting with respect to the tilting in the direction of the long side only.

(b) In the above embodiments, although the step portions and the recessed portion are provided on the male connector housing, such step portions and recessed portions may be provided at both of the opposed surfaces of the male and female connector housings, or may be provided only at the female connector housing. Additionally, guide ribs may be formed on the male connector housing with guide grooves formed on the female connector housing.

Figure 10:
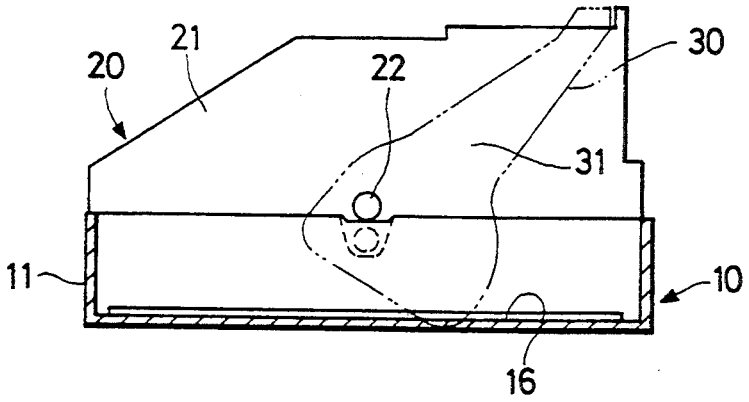
FIG. 10 is a schematic side-elevational view of an alternative embodiment.
Figure 11:
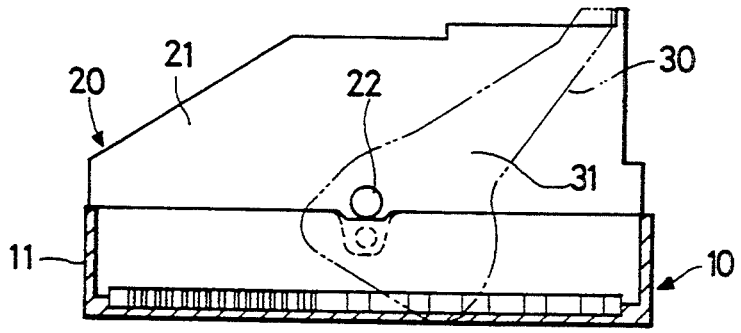
FIG. 11 is a schematic side-elevational view of an alternative embodiment.

(c) Although the present invention is applied to a hybrid-type connector having the power terminals of a larger size and the signal terminals of a smaller size, the present invention may also be applied to the type of connector, such as that shown in FIGS. 10 and 11, having one kind of terminal that provides an unbalanced distribution of the insertion resistance because of an uneven density arrangement of the terminals.

(d) Although the lever is mounted on the male connector housing while the cam reception projections are provided on the cover of the female connector housing in the above-described embodiments, the present invention is not limited to this description. Rather, the cam reception projections may be formed directly on the female connector housing. Further, the arrangement of the lever and the cam reception projections may be reverse to that of the above embodiments, that is, the former is provided on the female connector housing, and the latter may be provided on the male connector housing.

The present invention is not limited to the embodiments described above and shown in the drawings, and various modifications can be made without departing from the scope of the invention, which is defined in the following claims.

What is claimed is:

1. A lever-type connector comprising:

a lever pivotally mounted on one of two connector housings, wherein connection and disconnection of the two connector housings is effected using said lever;

a recessed portion formed on an opposed surface of one of the two connector housings; and a step portion formed on the one of the two connector housings, the step portion contacting a portion of the other one of the two connector housings and allowing at least one of the two connector housings to deform in a central location when said lever effects connection of the two connector housings, the step portion allowing one connector housing to move into a level position relative to the other connector housing.

2. A connector comprising:

a male connector housing for housing a plurality of male terminals;

a female connector housing for housing a plurality of female terminals to be respectively connected to said male terminals;

lever means, fixed to one of the male connector housing and the female connector housing, for urging one of the male connector housing and the female connector housing to engage the other one of the male connector housing and the female connector housing; and leveling means for allowing one of the male connector housing and the female connector housing to deform in at least a central location of said one connector housing when said lever means urges said one of the male connector housing and the female connector housing to engage the other one, and for allowing one of the male connector housing and the female connector housing to move into a level position relative to the other one of the male connector housing and the female connector housing.

3. The connector of claim 2, wherein the male terminals comprise power terminals positioned on one end of the male connector housing and signal terminals positioned on the other end of the male connector housing, the power terminals having a larger size than the signal terminals.

4. The connector of claim 2, wherein the male terminals provide an uneven distribution of insertion resistance between one end of the male connector housing with a respective end of the female connector housing and the other end of the male connector housing with a respective other end of the female connector housing.

5. The connector of claim 2, wherein the leveling means comprises at least one guide rib on one of the male connector housing and the female connector housing and at least one guide groove on the other one of the male connector housing and the female connector housing.

6. The connector of claim 2, wherein the leveling means comprises at least one step portion formed on at least one of the male connector housing and the female connector housing.

7. The connector of claim 6, wherein at least one step portion is formed at each opposite end of the respective connector housing.

8. The connector of claim 7, wherein one step portion is formed in each corner of the respective connector housing.

9. The connector of claim 6, wherein the leveling means further comprises a recessed portion formed on at least one of the male connector housing and the female connector housing.

10. The connector of claim 9, wherein the step portion has a height approximately 0.5 to 0.7 mm higher than the recessed portion.

11. The connector of claim 9, wherein the step portion and the recessed portion are formed on the male connector housing.

12. A connector comprising:

a male connector housing for housing a plurality of male terminals;

a female connector housing for housing a plurality of female terminals to be respectively connected to said male terminals;

a lever fixed to one of the male connector housing and the female connector housing, the lever urging one of the male connector housing and the female connector housing to engage the other one; and a step portion formed on at least one of the male connector housing and the female connector housing, the step portion contacting a portion of the other one of the male connector housing and the female connector housing and allowing at least one of the male connector housing and the female connector housing to deform in a central location when said lever urges said one of the male connector housing and the female connector housing, the step portion allowing the at least one of the male connector housing and the female connector housing to move into a level position.

13. The connector of claim 12, wherein the step portion forms a recess portion on the at least one of the male connector housing and the female connector housing, the recess portion further allowing the at least one of the male connector housing and the female connector housing to deform.

* * * * *